US010658735B2

(12) United States Patent
Caratelli et al.

(10) Patent No.: US 10,658,735 B2
(45) Date of Patent: May 19, 2020

(54) COMPONENT FOR A DUAL BAND ANTENNA, A DUAL BAND ANTENNA COMPRISING SAID COMPONENT, AND A DUAL BAND ANTENNA SYSTEM

(71) Applicant: The Antenna Company International N.V., Netherlands Antilles (CW)

(72) Inventors: Diego Caratelli, Duizel (NL); Thomas Bolz, Sonsbeck (DE)

(73) Assignee: THE ANTENNA COMPANY INTERNATIONAL N.V., Netherlands Antilles (CW)

( * ) Notice: Subject to any disclaimer, the term of this patent is extended or adjusted under 35 U.S.C. 154(b) by 22 days.

(21) Appl. No.: 16/048,595

(22) Filed: Jul. 30, 2018

(65) Prior Publication Data

US 2019/0036202 A1 Jan. 31, 2019

(30) Foreign Application Priority Data

Jul. 28, 2017 (NL) ..... 2019365

(51) Int. Cl.
*H01Q 1/38* (2006.01)
*H01Q 1/24* (2006.01)
(Continued)

(52) U.S. Cl.
CPC ..... *H01Q 1/246* (2013.01); *H01Q 1/38* (2013.01); *H01Q 1/48* (2013.01); *H01Q 5/30* (2015.01);
(Continued)

(58) Field of Classification Search
CPC ..... H01P 1/2005; H01Q 1/2291; H01Q 1/24; H01Q 1/246; H01Q 1/38; H01Q 1/48;
(Continued)

(56) References Cited

U.S. PATENT DOCUMENTS 5,243,353 A * 9/1993 Nakahara ..... H01Q 9/0457 343/700 MS
6,087,989 A * 7/2000 Song ..... H01Q 9/285 343/700 MS
(Continued)

OTHER PUBLICATIONS

Search Report for corresponding NL Patent Application No. 2019365 dated Apr. 11, 2018.

*Primary Examiner* — Tho G Phan
(74) *Attorney, Agent, or Firm* — Renner, Otto, Boisselle & Sklar, LLP

(57) ABSTRACT

Component for a dual band antenna suitable for integration in a router, an access point, or similar device for wireless communication, wherein the outside of the component is of a multi-faced design which is supported by a support body that is designed to be mounted onto a ground plane, wherein the outside of the component includes the following faces: a) a top face which is provided with an electrically conductive flare layer that encloses at least one flare slot; b) one or two side faces adjacent to the top face that are provided with an electrically conductive feed strip and an electrically conductive ground strip which strips are both electrically connected to the flare layer; c) a bottom face that is not adjacent to the top face, which is designed to be mounted onto the ground plane; wherein the ground strip is electrically connectable to the ground plane onto which the component is to be mounted, and wherein the feed strip is electrically connectable to an appropriate RF chain.

35 Claims, 6 Drawing Sheets

(51) Int. Cl.

| | |
|---|---|
| ***H01Q 5/30*** | (2015.01) |
| ***H01Q 9/04*** | (2006.01) |
| ***H01Q 1/48*** | (2006.01) |
| ***H01Q 5/371*** | (2015.01) |
| *H01Q 1/22* | (2006.01) |
| *H01Q 21/28* | (2006.01) |

(52) U.S. Cl.
CPC ..... *H01Q 5/371* (2015.01); *H01Q 9/0421* (2013.01); *H01Q 9/0442* (2013.01); *H01Q 1/2291* (2013.01); *H01Q 21/28* (2013.01)

(58) Field of Classification Search
CPC ..... H01Q 1/521; H01Q 21/00; H01Q 21/28; H01Q 5/30; H01Q 9/0421; H01Q 9/0442; H01Q 15/008; H01Q 5/371; F01D 5/186; F05D 2240/126; F05D 2240/127; F05D 2250/52; F05D 2260/202; F05D 2260/2214; H05K 1/0236; H05K 2201/09609; H05K 2201/09681; H05K 2201/0969; H05K 2201/2201
See application file for complete search history.

(56) References Cited

U.S. PATENT DOCUMENTS

| | | | | |
|---|---|---|---|---|
| 6,466,170 | B2 * | 10/2002 | Zhou | H01Q 1/243 343/700 MS |
| 6,498,586 | B2 * | 12/2002 | Pankinaho | H01Q 1/243 343/700 MS |
| 6,545,640 | B1 * | 4/2003 | Herve | H01Q 1/243 343/700 MS |
| 6,856,286 | B2 * | 2/2005 | Jo | H01Q 1/243 343/700 MS |
| 7,330,155 | B2 * | 2/2008 | Chan | H01Q 1/243 343/702 |
| 2001/0007445 | A1 | 7/2001 | Pankinaho | |
| 2004/0056804 | A1 | 3/2004 | Kadambi et al. | |
| 2004/0080457 | A1 | 4/2004 | Guo et al. | |
| 2004/0085244 | A1 | 5/2004 | Kadambi et al. | |
| 2004/0125030 | A1 | 7/2004 | Sung et al. | |
| 2004/0263396 | A1 | 12/2004 | Sung | |
| 2006/0290572 | A1 | 12/2006 | Chan | |
| 2009/0051595 | A1 | 2/2009 | Wang et al. | |

* cited by examiner

COMPONENT FOR A DUAL BAND ANTENNA, A DUAL BAND ANTENNA COMPRISING SAID COMPONENT, AND A DUAL BAND ANTENNA SYSTEM

The present invention relates to a component for a dual band antenna suitable for integration in a router, an access point, or similar device for wireless communication, wherein the outside of the component is of a multi-faced design which is supported by a support body that is designed to be mounted onto a ground plane.

The invention further relates to a dual band antenna comprising such a component, and a dual band antenna system comprising a multitude of such components.

Dual band antennas are attractive antennas to integrate with a printed circuit board (PCB), for instance in a router or access port for Wi-Fi applications. In that context, it has been proposed to devise a component that is designed to be mounted directly onto a ground plane—which may be a metallized top layer of a PCB—so that a dual band antenna is formed. Such a component which is mountable onto a PCB is commonly referred to in the field as a surface mounted device (SMD).

In order to achieve the most feasible integration of a dual band antenna with a PCB, a general demand exists in the field to miniaturize the antenna as much as possible, while retaining adequate radiation properties such as gain and efficiency.

While a reduced size of an antenna makes integration with a PCB more feasible in the first place, any successful step in miniaturization may also result in a further decline of any unwanted coupling effects that compromise the antenna functionality.

Apart from the above considerations, the uniformity of radiation pattern in both operational frequency bands of a dual band antenna, is of importance when high throughput levels are required such as in MIMO antenna applications. In that context, it has proven still a challenge to miniaturize the antenna on the one hand, while retaining satisfactory uniform radiation patterns in multiple bands simultaneously on the other hand.

It is therefore a general objective of the present invention to provide a dual band antenna comprising a component which is directly mountable onto a ground plane, wherein the antenna strikes an optimum balance in achieving the following properties:

A satisfactory gain and efficiency comparable or better than the prior art,

A reduced size compared to the prior art,

An optimum uniformity of the radiation pattern in both bands.

According to a first aspect of the invention, the above objective is reached by providing a component for a dual band antenna suitable for integration in a router, an access port, or similar device, wherein the outside of the component is of a multi-faced design which is supported by a support body that is designed to be mounted onto a ground plane, wherein the outside of the component includes the following faces:

a top face which is provided with an electrically conductive flare layer that encloses at least one flare slot;

one or two side faces adjacent to the top face that are provided with an electrically conductive feed strip and an electrically conductive ground strip which strips are both electrically connected to the flare layer;

a bottom face that is not adjacent to the top face, which is designed to be mounted onto the ground plane;

wherein the ground strip is electrically connectable to the ground plane onto which the component is to be mounted, and wherein the feed strip is electrically connectable to an appropriate RF chain.

For the sake of clarity, it is noted that connecting the feed strip with an appropriate RF chain is a requirement for allowing the dual band antenna to effectively function as a transceiver. The same holds for mounting the bottom face onto the ground plane and connecting the ground strip with the ground plane. The respective electrical connections are typically created by soldering. The mounting can be done by riveting or by heat staking.

The component according to the invention can be classified as (part of) a planar inverted-F antenna (PIFA-like antenna). The component according to the invention is configured to act as surface mounted device (SMD), wherein the SMD is mountable onto a ground plane. The component is ready-to-use, and does not require any discrete capacitor or switch to become operational.

Preferably, a single ground strip (ground pin) is used. The feed strip and the ground strip preferably have different designs. More in particular, the maximum width of the feed strip is preferably larger, and more preferably at least 2 times larger, than the maximum width of the ground strip. The feed strip and the ground strip are preferably provided onto different side faces, more preferably adjacent side faces.

The support body is typically made of at least one dielectric material, in particular plastic. The support body typically has a dual functionality, as the support body firstly acts as mechanical support (carrier) for a conductive antenna frame (formed by the flare layer, the ground strip, and the feed strip), and as the support body secondly acts as integral part of the antenna design, wherein the support body is configured to support the excitation of the dielectric resonances within the antenna volume (component volume).

The bottom face allows for gluing the bottom face onto a ground plane such as a metallized surface layer of a PCB. Other suitable techniques of mounting the bottom face onto the ground plane are encompassed as well.

The flare slot may be seen as an excised part of the flare layer, even though it does not necessarily have to be produced in that way.

The combination of the electrically conductive parts of the flare layer, feed strip, and ground strip are in this context also referred to as the electrical circuitry of the component.

The advantageous effects of the invention in terms of the measured properties of the antenna will be discussed in detail in the examples that follow below.

In the component according to the invention, it is preferred that the outside of the component has a hexahedral design, preferably in the form of a rectangular cuboid, or a cube.

The hexahedral design implies that the outside of the component has six faces. Such a design of the outside of the component was found most suitable for the invention.

Further in the component according to the invention, it is preferred that the dual band antenna is operable in the frequency ranges of 2.4-2.5 GHz and 4.9-6.0 GHz.

These frequency bands typically correspond to the most common WiFi bands, which make the antenna most suitable in that regard.

In particular it is preferred in the component according to the invention, that the support structure is made from a dielectric material with a dielectric constant in the range of 2 to 4, preferably 2.5 to 3.5.

For instance, a suitable material is any heat resistant thermoplastic material having appropriate dielectric properties, like ABS (acrylonitrile butadiene styrene), or PEEK (polyetheretherketone), or PPS (polyphenylene sulfide), or different varieties of engineered glasses. The heat resistance of those materials is a further preferred property, as some of the electrical connections of the component are typically made by soldering afterwards.

In a preferred version of the component according to the invention, the flare slot has a peninsular contour.

The peninsular contour implies that it contains two differently sized parts, comprising a relatively small and narrow contour connected to a relatively large, and wider contour.

The component according to the invention may be made using various techniques:

The support body may be injection molded using a suitable plastic as indicated above. Subsequently, a foil of electrically conductive material that is precisely stamped or cut to a pattern forming the electrical circuitry (flare layer, feed strip, ground strip) is adhered onto the support body. The electrically conductive material has to be solderable (e.g., copper) or plated with a solderable material (e.g., tin).

The support body is injection molded using a suitable thermoplastic composition which is doped with a non-conductive metallic inorganic compound. Subsequently, predetermined parts of the outer surface of the plastic composition are metallized by exposure to laser followed by and subsequent reductive copper coating. Such a technique is well-known as laser direct structuring (LDS).

A first class of preferred embodiments of the component according to the invention, is based on the outside of the component having a hexahedral design, and the support body being a hollow structure having an internal void that extends through the bottom face.

Such a support body having a hollow structure is commonly referred to as a shell structure. Such a structure requires a minimum amount of dielectric material to be formed, while offering adequate support for the electric circuitry of the component. In such a structure, the bottom face forms an open side of the component, while the other faces of the component may form fully or substantially closed sides. This first class of embodiments may be referred to as a component having a hollow design.

In the component according to the component having such a hollow design, it is preferred that the flare layer comprises a peninsular contour.

The peninsular contour of the flare layer implies that the contour contains two differently sized parts, comprising a relatively small and narrow contour connected to a relatively large, and wider contour.

As an alternative to the peninsular contour, the flare layer may contain a slotted ring, which means that the layer contains an insular part that is not connected to the rest of the layer as it is surrounded by a slot.

Further, in the component according to the invention having a hollow design, it is preferred that the flare layer encloses two flare slots having a peninsular contour. Preferably, the design and/or shape and/or dimensioning of the two flare slots are mutually different. Preferably, the flare slots extend in mutually different directions. This means that the longitudinal axis of the flare slot extends in different directions and mutually enclosed an angle, preferably a perpendicular angle (90 degrees angle). Preferably, the (contour) opening of the peninsular contour of a first flare slot is facing away, or at least not directed towards, the (contour) opening of the peninsular contour of a second flare slot. Preferably, the contour openings are facing different edges of the top face of the component.

In the component according to the invention having a hollow design, other preferred features are:

the support body is a structure of connected planar walls that have a thickness in the range of 0.5 to 2.0 mm, preferably about 1 mm.

the height of the component is 12 mm or smaller, preferably 10.5 mm or smaller.

the width and length of the component is 14 mm or smaller, preferably 13.5 mm or smaller.

A second class of preferred embodiments of a component according to the invention, is based on the outside of the component having a hexahedral design, and the support body being a solid structure.

The solid structure implies that the support body is virtually free of any substantial internal voids, in contrast to the component of a hollow design. Although requiring more material to form the support body, it is in general more simple to produce the solid structure by the commonly used techniques (typically: injection molding), than the component of a hollow design.

This second class of embodiments may be referred to as a component having a solid design.

In the component according to the invention having a solid design, further preferred features are:

the height of the component is 9 mm or smaller, preferably 8.5 mm or smaller.

the width and length of the component is 12 mm or smaller, preferably 11.5 mm or smaller.

A third class of preferred embodiments of a component according to the invention, is based on the outside of the component having a hexahedral design, which is not supported by a support body, and which outside includes the following faces:

a top face formed by an electrically conductive flare layer that encloses at least one flare slot;

one or two side faces adjacent to the top face formed by an electrically conductive feed strip and an electrically conductive ground strip which strips are both electrically connected to the flare layer;

a bottom face that is not adjacent to the top face, formed by an electrically conductive ground layer electrically connected to the ground strip;

wherein the feed strip is electrically connectable to an appropriate RF chain.

This third class has the advantage of lacking a support body and thus a simplified design, which makes it easier to produce this variant in terms of time and costs.

Optionally, the third class of preferred embodiments is further simplified by providing it without a bottom face.

Further preferred features of this third class, are presented in more detail below, with respect to a fourth aspect of the invention.

The component according to the invention is preferably substantially cubically shaped. In a cubical shape, the length, the width, and the height are identical and/or practically identical. Preferably, the width and the length of the component are identical. Preferably, the height of the component is at least 60%, more preferably at least 70%, in particular at least 73% of the width (or length), which leads to a cubical shape or a quasi-cubical shape (substantially cubical shape).

A second aspect of the invention relates to a dual band antenna comprising a component according to the first aspect of the invention, of which component the bottom face is mounted onto a ground plane.

The ground plane may be of any type or form, such as a simple metal plate, a metallized surface layer of a PCB, or a PCB, or any other support substrate or support plate.

According to a third aspect, the invention provides a dual band antenna system comprising a multitude of components according to the first aspect of the invention, of which components the bottom face is mounted onto one common ground plane.

Such a system comprises a multitude of dual band antenna units, which is particularly suitable for MIMO antenna applications.

In the dual band antenna system according to the third aspect of the invention, it is preferred that adjacent components are mounted on the common ground plane at a distance from each other that is larger than the width and the length of the respective components, and preferably 1.5 times larger.

Such a distance is preferred in order to control any unwanted coupling effects by interaction between individual dual band antenna units comprised in the system, which is detrimental for the radiation characteristics of the system as a whole.

For clarity it is remarked that the distance between adjacent components should be larger than both the width and the length of the respective components, implies that when width and length are of different size and/or the two adjacent components are different in width and length, the largest width or length value of the pair of components will be determining the preferred distance in between.

In the dual band antenna system according to the third aspect of the invention, the following preferred distances between adjacent components mounted onto the common ground plane are applicable:

For adjacent components having a hollow design:

A distance of 75 mm or more, when the largest width or length value of the pair of components is 14 mm or smaller, preferably 13.5 mm or smaller.

For adjacent components having a solid design:

A distance of 20 mm or more, (38 mm) when the largest width or length value of the pair of components is 12 mm or smaller, preferably 11.5 mm or smaller.

BRIEF DESCRIPTION OF THE DRAWINGS

The invention will be further explained by two main examples each of which represents a preferred class of the component according to the invention, and which are presented with reference to the appended figures, wherein:

FIG. 1 shows a component 1 for a dual band antenna suitable for integration in a router, an access port, or similar device, which has an outside of a hexahedral design, i.e. a cube. The outside contains a metal sheet structure supported by a support body 3 made from PEEK, having a height h of 10.5 mm, a width w of 13.5 mm, and a length l of 13.5 mm. Three faces of the hexahedral outside of the component 1 are visible: a top face 5, and two side faces 10 and 11. The component is of a hollow design according to the first preferred class of components.

Figure 1:
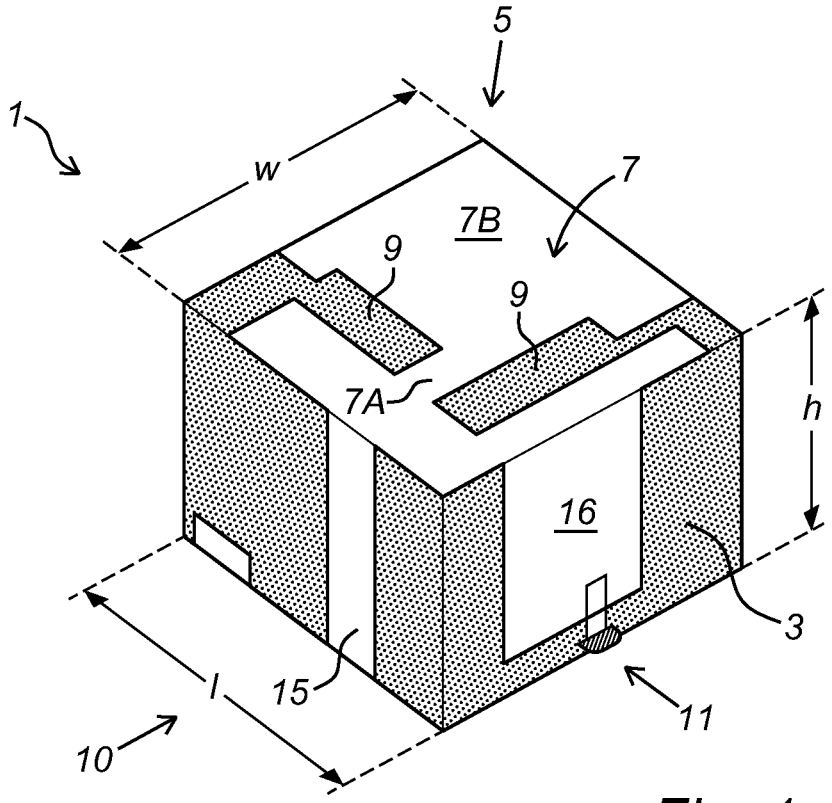
FIG. 1 is a perspective top view of a first preferred class of a component according to the invention.

The top face 5 is provided with an electrically conductive flare layer 7 which encloses two flare slots 9. The flare layer 7 itself comprises a peninsular contour, in that it contains two differently sized parts, comprising a relatively small and narrow contour 7A connected to a relatively large, and wider contour 7B.

Also the flare slots 9 have a peninsular contour comprising a relatively small and narrow contour at the beginning connected to a relatively large, and wider contour at the end. The side face 10 is provided with a ground strip 15, and the side face 11 is provided with a feed strip 16 which is connectable to a RF chain.

The electrically conductive parts are made from copper and/or aluminium.

Figure 2:
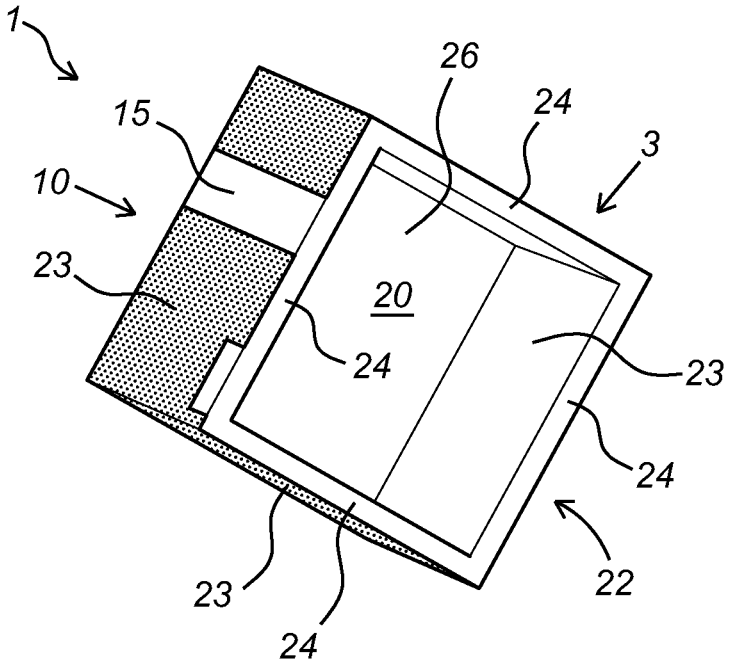
FIG. 2 is a perspective bottom view of the component shown in FIG. 1.

FIG. 2 shows the same component 1 as in FIG. 1, in perspective from the bottom face 22, wherein identical features are indicated by the same reference numerals as in FIG. 1. The support body 3 is a structure of four connected planar side walls 23 that are connected to one planar top wall 26, forming a hollow cube with an internal void 20 with an open bottom face 22 that is delimited by the visible bottom edges 24 of the walls 23. All four walls 23 and top wall 26 have a thickness in the range of 0.5 to 2.0 mm, preferably about 1 mm. The bottom face 22 is designed to be mounted onto a ground plane by virtue of the bottom edges 24.

The ground strip 15 is electrically connectable to a (not shown) ground plane. The component of hollow design weighs about 1 g.

Figure 3:
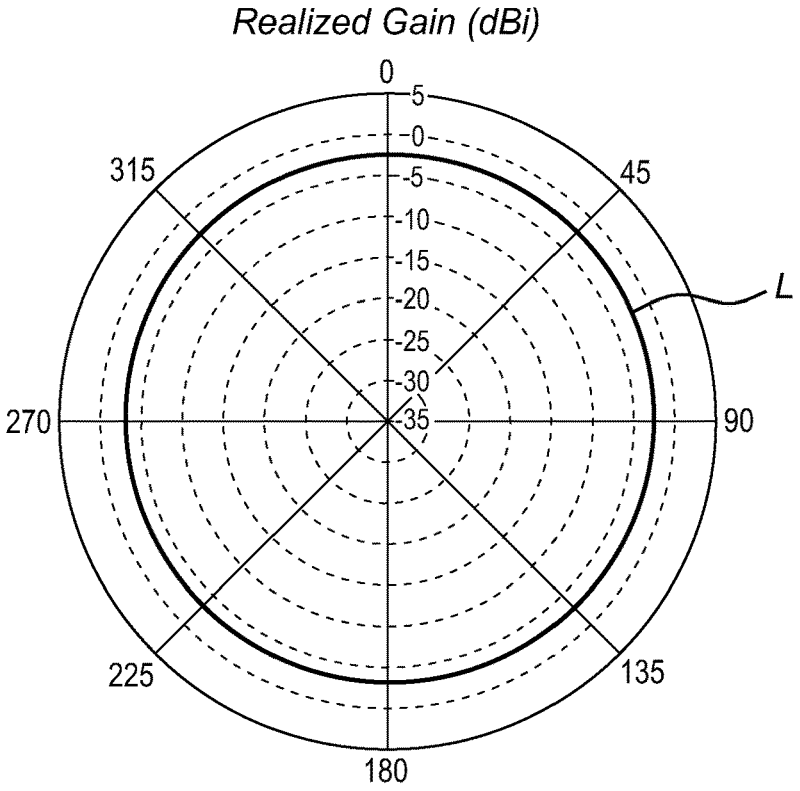
FIGS. 3 and 4 are radiation patterns of a dual band antenna which comprises the component shown in FIG. 1.

FIG. 3 is a diagram showing a 2D-radiation pattern at 2.45 GHz, under the conditions theta=90 degrees, phi is variable, for a dual band antenna based on the component described above in regard of FIGS. 1 and 2, which is mounted onto a ground plane.

The dual band antenna is made operable by electrically connecting the ground strip to a ground plane and the feed strip to an appropriate RF chain.

The line L drawn in the diagram shows the realized gain of the antenna in all directions, and to what extent there is uniformity accomplished at varying directions.

Figure 4:
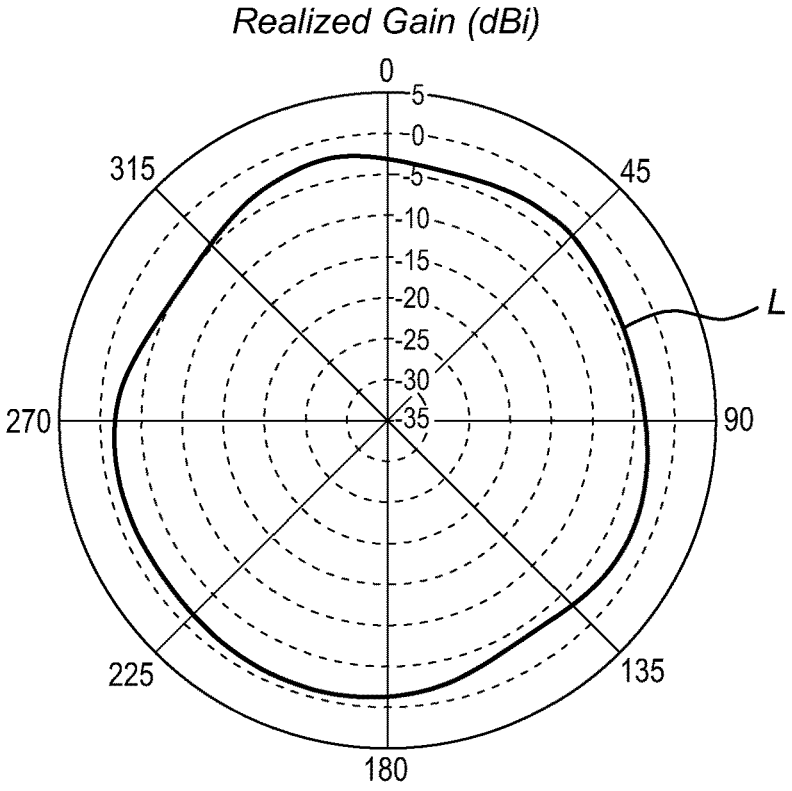

FIG. 4 is a diagram showing a 2D-radiation pattern at 5.54 GHz, under the conditions theta=90 degrees, phi is variable, for the same dual band antenna as referred to in regard of FIG. 3.

The line L drawn in the diagram shows the realized gain of the antenna in all directions, and to what extent there is uniformity accomplished at varying directions.

Figure 5:
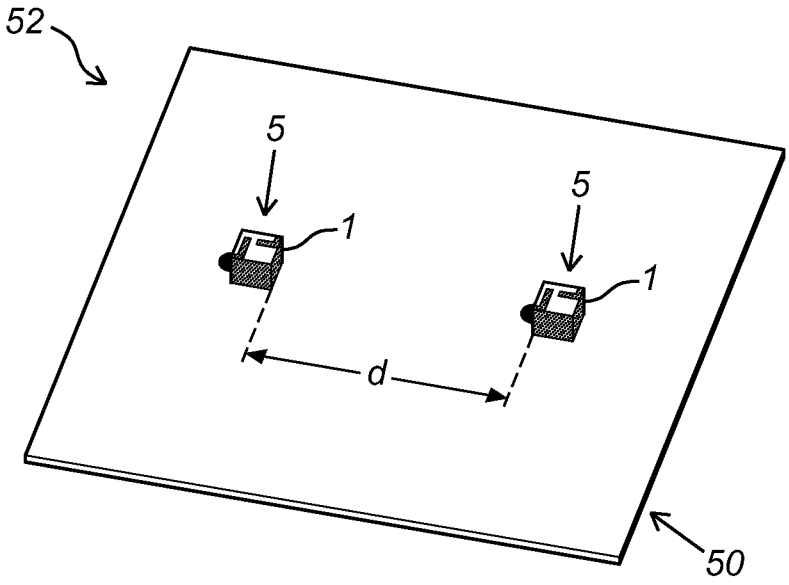
FIG. 5 is a perspective top view of a dual band antenna system comprising two components shown in FIG. 1.

FIG. 5 shows in perspective a top view of a dual band antenna system 52 comprising two identical components 1 as described above in regard of FIGS. 1 and 2 with visible top faces 5 that are facing upwards. The non-visible bottom faces of components 1 are mounted onto a common ground plane 50. Each component 1 is made operable by electrically connecting the ground strip to the ground plane and the feed strip to an appropriate RF chain.

The adjacent components 1 are mounted on the common ground plane 50 at a distance d from each other which is about 4 times larger than the largest value of the width or length of the components.

Figure 6:
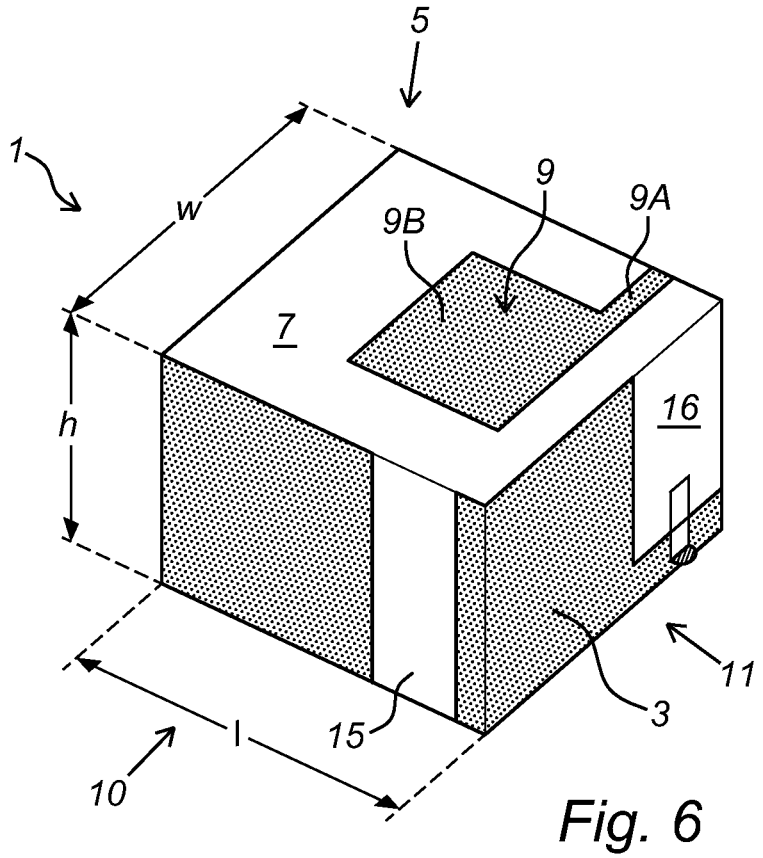
FIG. 6 is a perspective top view of a second preferred class of a component according to the invention.

FIG. 6 shows a component 61 for a dual band antenna suitable for integration in a router, an access port, or similar device, which has an outside of a hexahedral design, i.e. a cube. Features that correspond to the features of FIG. 1, have the same reference numbers. The outside is supported by a support body 3 made from PEEK, having a height h of 8.5 mm, a width w of 11.5 mm, and a length l of 11.5 mm. Three faces of the hexahedral outside of the component 1 are visible: a top face 5, and two side faces 10 and 11.

The component is of a solid design according to the second preferred class of components.

The top face 5 is provided with an electrically conductive flare layer 7 which encloses one flare slot 9. The flare slot 9 has a peninsular contour comprising a relatively small and narrow contour 9A at the beginning connected to a relatively large, and wider contour 9B at the end. The side face 10 is provided with a ground strip 15, and the side face 11 is provided with a feed strip 16 which is connectable to a RF chain.

Figure 7:
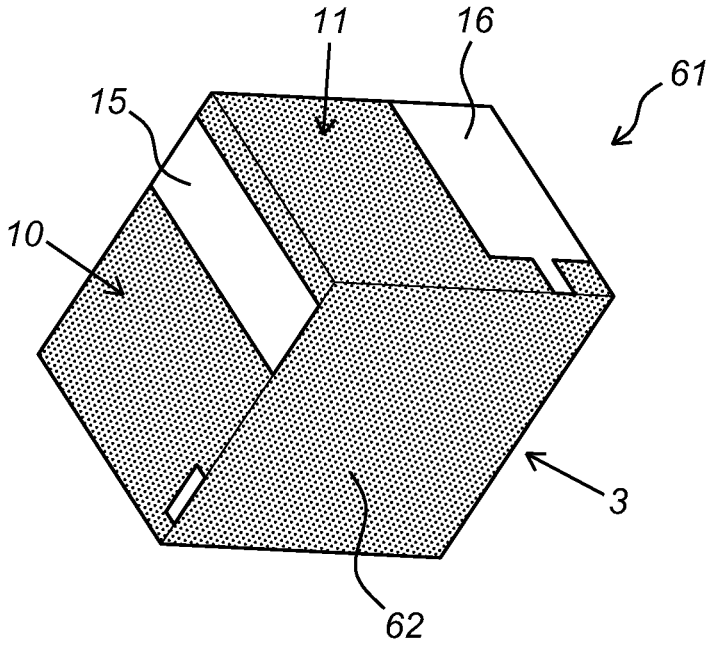
FIG. 7 is a perspective bottom view of the component shown in FIG. 6.

FIG. 7 shows the same component 61 as in FIG. 6, in perspective from the bottom face 62, wherein identical features are indicated by the same reference numerals as in FIG. 1. The support body 3 is a solid cube structure, the bottom face 62 is designed to be mounted onto a ground plane.

The ground strip 15 is electrically connectable to a (not shown) ground plane. The component 61 of solid design weighs about 2 g.

Figure 8:
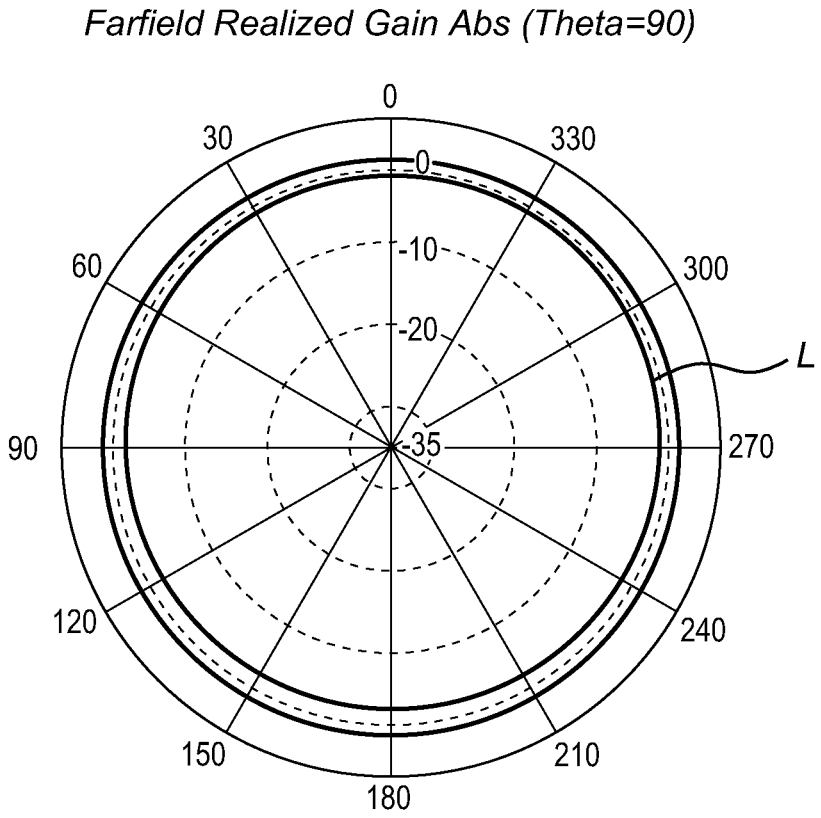
FIGS. 8 and 9 are radiation patterns of a dual band antenna which comprises the component shown in FIG. 6.

FIG. 8 is a diagram showing a 2D-radiation pattern at 2.50 GHz, under the conditions theta=90 degrees, phi is variable, for a dual band antenna based on the component 61 described above in regard of FIGS. 6 and 7, which is mounted onto a ground plane.

The dual band antenna is made operable by electrically connecting the ground strip to a ground plane and the feed strip to an appropriate RF chain.

The line L drawn in the diagram shows the realized gain of the antenna in all directions, and to what extent there is uniformity accomplished at varying directions.

Figure 9:
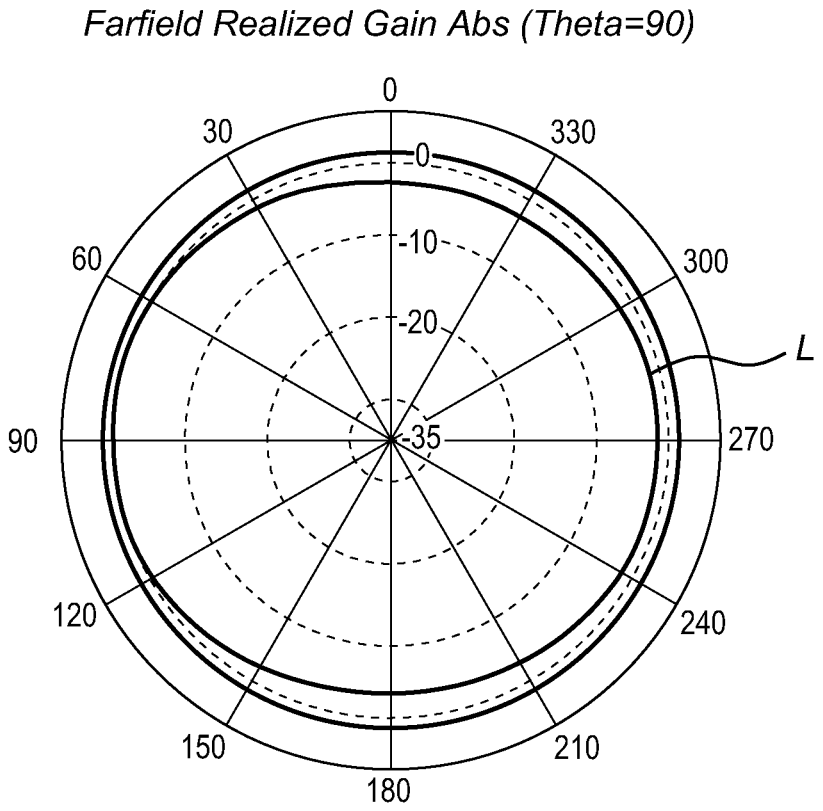

FIG. 9 is a diagram showing a 2D-radiation pattern at 5.54 GHz, under the conditions theta=90 degrees, phi is variable, for the same dual band antenna as referred to in regard of FIG. 8.

The line L drawn in the diagram shows the realized gain of the antenna in all directions, and to what extent there is uniformity accomplished at varying directions.

Figure 10:
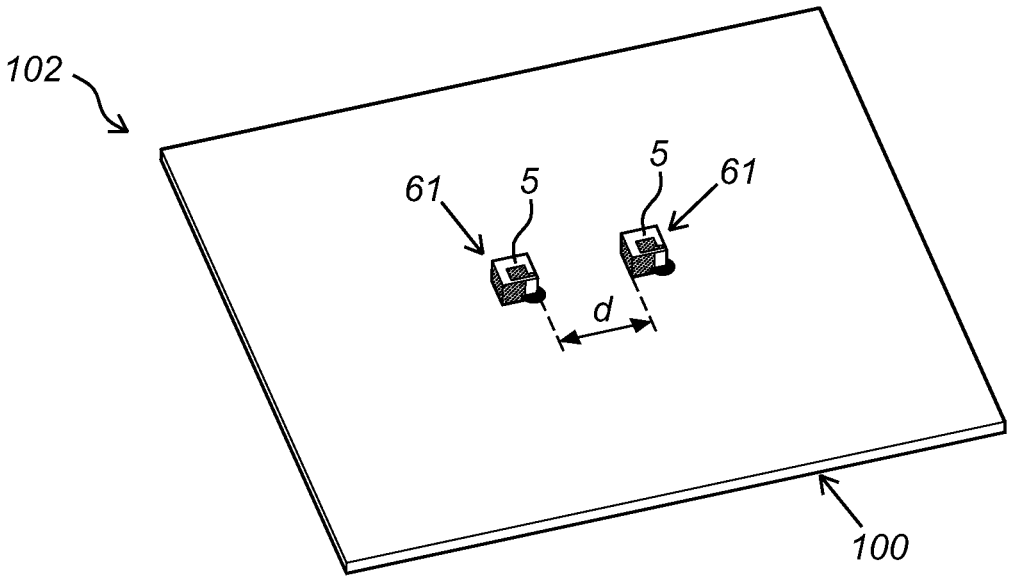
FIG. 10 is a perspective top view of a dual band antenna system comprising two components shown in FIG. 6.

FIG. 10 shows in perspective a top view of a dual band antenna system 102 comprising two identical components 61 as described above in regard of FIGS. 6 and 7 with visible top faces 5 that are facing upwards. The non-visible bottom faces of components 61 are mounted onto a common ground plane 100. Each component 61 is made operable by electrically connecting the ground strip to the ground plane and the feed strip to an appropriate RF chain.

The adjacent components 61 are mounted on the common ground plane 100 at a distance d from each other which is about 2 times larger than the largest value of the width or length of the components 61.

EXAMPLES

Example 1

The first example is a dual band antenna based on the component described above in regard of FIGS. 1 and 2, which is mounted onto a ground plane.

This first example is a representative of a dual band antenna based on a component having a hollow design.

The following antenna characteristics were measured for the first example:

| Frequency range (GHz) | Efficiency (%) | Max. gain (dBi) | Return Loss (dB) | VSWR | Impedance (Ω) |
|---|---|---|---|---|---|
| 2.40-2.50 | 93 | 4.3 | <−10 | <2 | 50 |
| 4.9-6.0 | 89 | 5.0 | <−10 | <2 | 50 |

Example 2

The second example is a dual band antenna based on the component described above in regard of FIGS. 6 and 7, which is mounted onto a ground plane.

This second example is a representative of a dual band antenna based on a component having a solid design.

The following antenna characteristics were measured for the second example:

| Frequency range (GHz) | Efficiency (%) | Max. gain (dBi) | Return Loss (dB) | VSWR | Impedance (Ω) |
|---|---|---|---|---|---|
| 2.40-2.50 | 91 | 4.1 | <−10 | <2 | 50 |
| 4.9-6.0 | 89 | 4.7 | <−10 | <2 | 50 |

The above results prove that both examples which are representative for the two preferred main classes of a dual band antenna according to the invention, achieve a satisfactory gain and efficiency comparable or even better than the prior art.

Furthermore, both the exemplified embodiments are based on components that are relatively small in size when compared to the prior art.

In that context, it has been found that the second preferred class allows for an even further size reduction than the first preferred class.

In addition to the above, the exemplified embodiments achieve an optimum uniformity of the radiation pattern as is apparent from the diagrams shown in FIGS. 3, 4, 8, and 9.

A fourth aspect of the invention, relates to:

A dual band antenna suitable for integration in a router, an access point, or similar device for wireless communication, wherein the outside of the dual band antenna is of a multi-faced design which includes the following faces:

a top face formed by an electrically conductive flare layer that encloses at least one flare slot;

one or two side faces adjacent to the top face formed by an electrically conductive feed strip and an electrically conductive ground strip which strips are both electrically connected to the flare layer;

a bottom face that is not adjacent to the top face, formed by an electrically conductive ground layer electrically connected to the ground strip;

wherein the feed strip is electrically connectable to an appropriate RF chain.

According to this fourth aspect, the dual band antenna achieves as a general objective of the invention, the provision of a dual band antenna which strikes an optimum balance in achieving the following properties:

A satisfactory gain and efficiency comparable or better than the prior art,

A reduced size compared to the prior art.

As such, the dual band antenna is attractive in size and function, for integration in wireless communication devices.

The faces of the dual band antenna are essentially made from electrically conductive material, e.g. copper or tin. No dielectric support material is applied in this type of dual band antenna.

The special dual band antenna is for instance produced by metal injection molding (MIM), or by stamping or cutting a foil of electrically conductive material and folding it into a corresponding multi-faced design.

The features of the antenna according to the fourth aspect that are in common with the first and second aspect of the invention, have been clarified above.

The following features are preferred in the dual band antenna according to the fourth aspect:

the height of the dual band antenna is 11 mm or smaller, preferably 10.5 mm or smaller.

the width and length of the dual band antenna is 16 mm or smaller, preferably 15 mm or smaller.

the outside of the dual band antenna has a hexahedral design, preferably in the form of a rectangular cuboid, or a cube.

the dual band antenna is operable in the frequency ranges of 2.4-2.5 GHz and 4.9-6.0 GHz.

the flare layer comprises a peninsular contour.

the flare layer encloses one or two flare slots, preferably having a peninsular contour.

Importantly, the flare layer has an irregular, intricate shape, as opposed to a simple rectangle or circle.

The bottom face of the dual band antenna formed by the ground layer can be readily adhered onto a metal layer of a PCB from a device for wireless communication in any conceivable way. As such the antenna is expediently integrated with the device.

Figure 11:
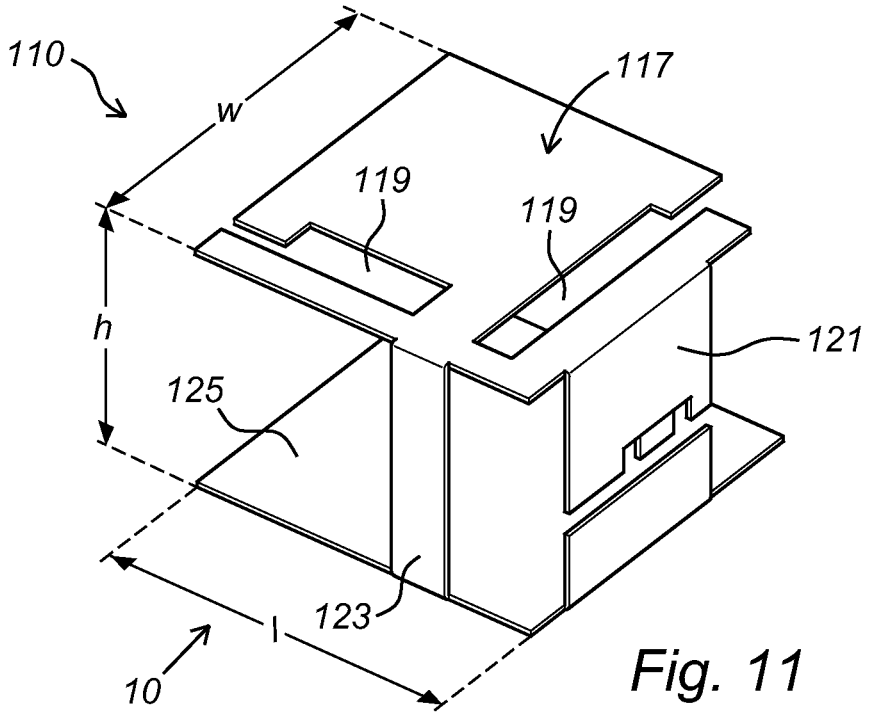
FIG. 11 is a perspective top view of a dual band antenna according to the fourth aspect of the invention, which includes an irregularly shaped flare layer.
Figure 12:
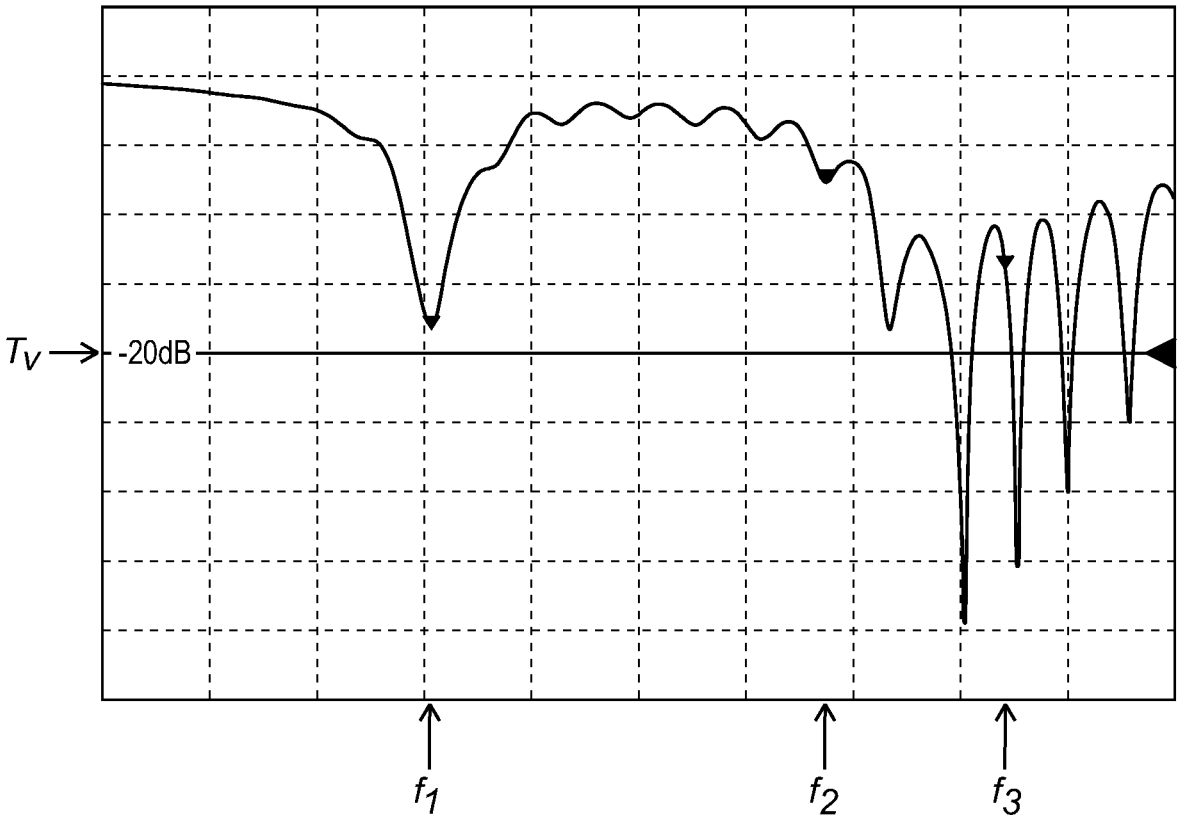
FIG. 12 is a radiation measurement of the dual band antenna of FIG. 11.

The invention according to the fourth aspect which is similar to the third preferred class, will be further explained with reference to the appended figures, wherein:

FIG. 11 is a perspective top view of a prototype of a dual band antenna according to the fourth aspect of the invention;

FIG. 12 is a radiation measurement of the dual band antenna of FIG. 11.

FIG. 11 shows a dual band antenna 110 suitable for integration in a router, an access point, or similar device for wireless communication, wherein the outside of the dual band antenna is of a multi-faced design which includes the following faces:

a top face formed by an electrically conductive flare layer 117 that encloses two flare slots 119;

one or two side faces adjacent to the top face formed by an electrically conductive feed strip 121 and an electrically conductive ground strip 123 which strips are both electrically connected to the flare layer 117;

a bottom face that is not adjacent to the top face, formed by an electrically conductive ground layer 125 electrically connected to the ground strip 123;

wherein the feed strip 121 is electrically connectable to an appropriate RF chain.

The outside of the dual band antenna is of a hexahedral design, i.e. a cube. The antenna is made out of copper plates of 0.3 mm thickness. The hexahedral design has a height h of 10.5 mm, a width w of 15 mm, and a length I of 15 mm.

FIG. 12 shows a graph of the measured return loss with reference to a benchmark value of −20 dB marked by tv on the Y-axis of. Satisfactory large and broad peaks are observed in the frequency ranges of 2.4-2.5 GHz (marked by f1) and 4.9-6.0 GHz (marked by f2 and f3 resp.).

In conclusion, the dual band antenna according to FIG. 11 exhibits good matching characteristics and sufficient bandwidth in both frequency bands.

The invention claimed is:

1. Component for a dual band antenna suitable for integration in a router, an access point, or similar device for wireless communication, wherein the outside of the component is of a multi-faced design which is supported by a support body that is designed to be mounted onto a ground plane, wherein the outside of the component includes the following faces:

a top face which is provided with an electrically conductive flare layer that encloses at least one flare slot;

one or two side faces adjacent to the top face that are provided with an electrically conductive feed strip and an electrically conductive ground strip which strips are both electrically connected to the flare layer, such that each of the feed strip and the ground strip extends over a single side face and forms a direct connection between the flare layer and a feed, respectively between the flare layer and a ground;

a bottom face that is not adjacent to the top face, which is designed to be mounted onto the ground plane;

wherein the ground strip is electrically connectable to the ground plane onto which the component is to be mounted, and wherein the feed strip is electrically connectable to an appropriate RF chain.

2. Component according to claim 1, wherein the outside of the component has a hexahedral design.

3. Component according to claim 2, wherein the outside of the component has a hexahedral design, and the support body is a hollow structure having an internal void that extends through the bottom face.

4. Component according to claim 3, wherein the flare layer comprises a peninsular contour.

5. Component according to claim 3, wherein the flare layer encloses two flare slots having a peninsular contour.

6. Component according to claim 3, wherein the support body is a structure of connected planar walls that have a thickness in the range of 0.5 to 2.0 mm.

7. Component according to claim 3, wherein the height of the component is 12 mm or smaller.

8. Component according to claim 3, wherein the width and length of the component is 14 mm or smaller.

9. Component according to claim 2, wherein the outside of the component has a hexahedral design, and the support body is a solid structure.

10. Component according to claim 9, wherein the height of the component is 9 mm or smaller.

11. Component according to claim 9, wherein the width and length of the component is 12 mm or smaller.

12. Component according to claim 2, wherein the outside of the component has a hexahedral design, and is not supported by a support body, which outside includes the following faces:

a top face formed by an electrically conductive flare layer that encloses at least one flare slot;

one or two side faces adjacent to the top face formed by an electrically conductive feed strip and an electrically conductive ground strip which strips are both electrically connected to the flare layer;

a bottom face that is not adjacent to the top face, formed by an electrically conductive ground layer electrically connected to the ground strip;

wherein the feed strip is electrically connectable to an appropriate RF chain.

13. Component according to claim 12, without a bottom face.

14. Component according to claim 1, wherein the dual band antenna is operable in the frequency ranges of 2.4-2.5 GHz and 4.9-6.0 GHz.

15. Component according to claim 1, wherein the support structure is made from a dielectric material with a dielectric constant in the range of 2 to 4.

16. Component according to claim 1, wherein the flare slot has a peninsular contour.

17. Component according to claim 1, wherein the component is configured to act as surface mounted device (SMD), wherein the SMD is mountable onto the ground plane.

18. Component according to claim 1, wherein a single ground strip applied.

19. Component according to claim 1, wherein the maximum width of the feed strip is larger than the maximum width of the ground strip.

20. Component according to claim 1, wherein the feed strip and the ground strip are provided onto different side faces.

21. Component according to claim 1, wherein the support body is made of at least one dielectric material.

22. Component according to claim 1, wherein the support body is configured both to mechanically support the flare layer, the ground strip, and the feed strip, and to support the excitation of the dielectric resonances within the component volume.

23. Component according to claim 1, wherein two flare slots are enclosed by the flare layer, wherein said two flare slots have mutually different shapes.

24. Component according to claim 1, wherein two flare slots are enclosed by the flare layer, wherein the flare slots extend in mutually different directions.

25. Component according to claim 1, wherein two flare slots are enclosed by the flare layer, wherein the contour opening of the peninsular contour of a first flare slot is facing away, or at least not directed towards, the contour opening of the peninsular contour of a second flare slot.

26. Component according to claim 1, wherein the component has a hexahedral design.

27. Component according to claim 1, wherein the width and the length of the component are identical.

28. Component according to claim 1, wherein the height of the component is 11 mm or smaller.

29. Component according to claim 1, wherein the width and length of the component are 16 mm or smaller.

30. Component according to claim 1, wherein the height of the component is at least 60% of the width of the component.

31. Dual band antenna comprising at least one component according to claim 1, of which component the bottom face is mounted onto a ground plane.

32. Dual band antenna according to claim 31, wherein the component is a planar inverted-F antenna (PIFA).

33. Dual band antenna according to claim 31, wherein the dual band antenna is operable in the frequency ranges of 2.4-2.5 GHz and 4.9-6.0 GHz.

34. Dual band antenna system comprising a multitude of components according to claim 1, of which components the bottom face is mounted onto one common ground plane.

35. Dual band antenna system according to claim 34, wherein adjacent components are mounted on the common ground plane at a distance from each other that is larger than the width and the length of the respective components.

* * * * *